US008535455B2

(12) United States Patent
Takashima et al.

(10) Patent No.: US 8,535,455 B2
(45) Date of Patent: Sep. 17, 2013

(54) TREATMENT SOLUTION FOR INSULATION COATING FOR GRAIN ORIENTED ELECTRICAL STEEL SHEET AND METHOD FOR PRODUCING GRAIN ORIENTED ELECTRICAL STEEL SHEET HAVING INSULATION COATING

(75) Inventors: Minoru Takashima, Tokyo (JP); Mineo Muraki, Tokyo (JP); Makoto Watanabe, Tokyo (JP); Tomofumi Shigekuni, Tokyo (JP)

(73) Assignee: JFE Steel Corporation (JP)

( * ) Notice: Subject to any disclaimer, the term of this patent is extended or adjusted under 35 U.S.C. 154(b) by 19 days.

(21) Appl. No.: 12/673,982

(22) PCT Filed: Aug. 20, 2008

(86) PCT No.: PCT/JP2008/065232

§ 371 (c)(1),
(2), (4) Date: Feb. 18, 2010

(87) PCT Pub. No.: WO2009/025389

PCT Pub. Date: Feb. 26, 2009

(65) Prior Publication Data

US 2011/0067786 A1 Mar. 24, 2011

(30) Foreign Application Priority Data

Aug. 23, 2007 (JP) ..... 2007-217570

(51) Int. Cl.
*C21D 1/68* (2006.01)

(52) U.S. Cl.
USPC ..... 148/28; 148/113

(58) Field of Classification Search
USPC ..... 148/208
See application file for complete search history.

(56) References Cited

U.S. PATENT DOCUMENTS

| | | | | |
|---|---|---|---|---|
| 3,856,568 | A | 12/1974 | Tanaka et al. | |
| 3,932,201 | A * | 1/1976 | Steger | 148/113 |
| 3,985,583 | A | 10/1976 | Shimanaka et al. | |
| 4,120,702 | A * | 10/1978 | Akerblom | 148/245 |
| 6,074,464 | A * | 6/2000 | Eddinger et al. | 106/14.12 |
| 8,268,097 | B2 * | 9/2012 | Takahashi et al. | 148/308 |
| 2008/0302448 | A1 * | 12/2008 | Frey et al. | 148/274 |
| 2011/0039114 | A1 * | 2/2011 | Takahashi et al. | 428/433 |

FOREIGN PATENT DOCUMENTS

| | | | |
|---|---|---|---|
| JP | 48-039338 | A | 6/1973 |
| JP | 50-079442 | A | 6/1975 |
| JP | 54-130615 | | 10/1979 |
| JP | 54-130615 | A | 10/1979 |
| JP | 57-009631 | | 2/1982 |
| JP | 57-009631 | B | 2/1982 |
| JP | 58-044744 | B | 10/1983 |

* cited by examiner

*Primary Examiner* — George Wyszomierski
(74) *Attorney, Agent, or Firm* — DLA Piper LLP (US)

(57) ABSTRACT

A treatment solution for an insulation coating for a grain oriented electrical steel sheet includes at least one member selected from phosphates of Mg, Ca, Ba, Sr, Zn, Al, and Mn, and colloidal silica in a proportion of 0.5 to 10 mol in terms of $SiO_2$ and at least one member selected from permanganates of Mg, Sr, Zn, Ba, and Ca in a proportion of 0.02 to 2.5 mol in terms of metal elements in the permanganates, relative to $PO_4$:1 mol in the phosphates.

4 Claims, 2 Drawing Sheets

TREATMENT SOLUTION FOR INSULATION COATING FOR GRAIN ORIENTED ELECTRICAL STEEL SHEET AND METHOD FOR PRODUCING GRAIN ORIENTED ELECTRICAL STEEL SHEET HAVING INSULATION COATING

RELATED APPLICATIONS

This is a §371 of International Application No. PCT/JP2008/065232, with an international filing date of Aug. 20, 2008 (WO 2009/025389 A1, published Feb. 26, 2009), which is based on Japanese Patent Application No. 2007-217570, filed Aug. 23, 2007, the subject matter of which is incorporated by reference.

TECHNICAL FIELD

This disclosure relates to a treatment solution for insulation coating for grain oriented electrical steel sheet for use in the production of a grain oriented electrical steel sheet excellent in tension induced by a coating, moisture-absorption resistance, rust resistance, and lamination factor. The disclosure also relates to a method for producing a grain oriented electrical steel sheet having an insulation coating using the treatment solution for insulation coating for grain oriented electrical steel sheet.

BACKGROUND

In recent years, the noise from power transformers poses problems as environmental pollution. The noise of power transformers is mainly caused by magnetostriction of a grain oriented electrical steel sheet used as an iron core material of transformers. It is required to reduce the magnetostriction of the grain oriented electrical steel sheet to reduce the noise of transformers. An industrially advantageous solution is to cover the grain oriented electrical steel sheet with an insulation coating.

As properties required for insulation coatings for grain oriented electrical steel sheets, tension induced by a coating, moisture-absorption resistance, rust resistance, and lamination factor are mentioned. Among the properties, securing the tension induced by a coating is important for the reduction in the magnetostriction. The tension induced by a coating refers to tension given to grain oriented electrical steel sheets by the formation of insulation coatings.

The coatings of grain oriented electrical steel sheets generally contain a ceramic forsterite coating formed by secondary recrystallization annealing and a phosphate-based insulation coating provided thereon. As a method for forming the insulation coating, techniques disclosed in Japanese Unexamined Patent Application Publication Nos. 48-39338 and 50-79442 are known. In these techniques, a treatment solution for insulation coating containing colloidal silica, phosphates, and chromium compounds (e.g., one or two or more members selected from chromic anhydrides, chromates, and dichromates) is applied to a steel sheet, and then the steel sheet is baked.

The insulation coatings formed by these methods have effects of improving the magnetostriction properties by giving tensile stress to grain oriented electrical steel sheets. However, the treatment solutions for insulation coating contain chromium compounds, such as chromic anhydrides, chromates, or dichromates, as components for maintaining favorable moisture-absorption resistance of the insulation coating, resulting in the fact that the treatment solutions for insulation coating contain hexachromium derived from the chromium compounds. Japanese Unexamined Patent Application Publication No. 50-79442 also discloses a technique of adding no chromium compounds. However, the technique is extremely disadvantageous from the viewpoint of moisture-absorption resistance. The hexachromium contained in the treatment solution for insulation coating is reduced into trivalent chromium by baking to be detoxicated. However, there arise problems in that various difficulties occur in handling in waste liquid treatment of the treatment solution.

In contrast, as a so-called "chromium-free treatment solution for insulation coating for grain oriented electrical steel sheet not substantially containing chromium," Japanese Examined Patent Application Publication No. 57-9631 discloses a treatment solution for insulation coating containing colloidal silica, aluminum phosphate, and boric acid, and further containing one or two or more members selected from sulfates of Mg, Al, Fe, Co, Ni, and Zn. Moreover, Japanese Examined Patent Application Publication No. 58-44744 also discloses a treatment solution for insulation coating containing colloidal silica and magnesium phosphate and further containing one or two or more members selected from sulfates of Mg, Al, Mn, and Zn. However, the use of the treatment solutions for insulation coating of Japanese Examined Patent Application Publication Nos. 57-9631 and 58-44744 has caused problems in terms of tension induced by a coating and moisture-absorption resistance in a request to coating properties in recent years.

As a technique to improve the moisture-absorption resistance of insulation coatings in the chromium-free treatment solutions for insulation coating, Japanese Unexamined Patent Application Publication No. 54-130615 discloses a treatment solution for insulation coating in which a compound containing a permanganate ion has been added to an aqueous solution of magnesium phosphate and/or aluminum phosphate. The treatment solution for insulation coating of Japanese Unexamined Patent Application Publication No. 54-130615 does not contain colloidal silica, and thus is disadvantageous from the viewpoint of the tension induced by a coating.

When sodium permanganates or potassium permanganates that are specifically described in Japanese Unexamined Patent Application Publication No. 54-130615 are incorporated in treatment solutions for insulation coating containing colloidal silica, there arise problems of reduction in the tension induced by a coating and deterioration of the rust resistance.

It could therefore be helpful to achieve the following:

- Preventing the reduction in tension induced by a coating and moisture-absorption resistance which poses a problem when a treatment solution for insulation coating is rendered chromium-free,
- Providing a treatment solution for insulation coating for grain oriented electrical steel sheet capable of providing a grain oriented electrical steel sheet having excellent insulation coating properties, i.e., excellent tension induced by a coating, moisture-absorption resistance, rust resistance, and lamination factor, and
- Providing a method for producing a grain oriented electrical steel sheet having an insulation coating using the treatment solution for insulation coating for grain oriented electrical steel sheet described above.

SUMMARY

We applied a treatment solution for insulation coating containing various water-soluble metal salts in addition to phosphate and colloidal silica to a grain oriented electrical steel sheet after it was subjected to secondary recrystallization annealing, and then baked the grain oriented electrical steel sheet. Then, the properties of the obtained coating were examined. As a result, we found that an insulation coating having desired properties can be obtained by adding permanganates of divalent metals, such as Mg, Sr, Zn, Ba, and Ca.

We thus provide:

(1) A treatment solution for insulation coating for grain oriented electrical steel sheet contains:

at least one member selected from phosphates of Mg, Ca, Ba, Sr, Zn, Al, and Mn; and colloidal silica in a proportion of 0.5 to 10 mol in terms of $SiO_2$ and at least one member selected from permanganates of Mg, Sr, Zn, Ba, and Ca in a proportion of 0.02 to 2.5 mol in terms of metal elements in the permanganates, relative to $PO_4$:1 mol in the phosphates.

Preferably, the treatment solution for insulation coating is chromium-free, and, particularly preferably, the treatment solution for insulation coating does not substantially contain Cr. The treatment solution is preferably a water-based solution.

(2) A method for producing a grain oriented electrical steel sheet having an insulation coating includes a series of processes of forming a slab for grain oriented electrical steel sheet into a sheet having a final sheet thickness by rolling, subjecting the sheet to primary recrystallization annealing, then subjecting the sheet to secondary recrystallization annealing, applying a treatment solution for insulation coating to the sheet, and then baking the sheet, in which, as the treatment solution for insulation coating, a treatment solution for insulation coating is used which contains:

at least one member selected from phosphates of Mg, Ca, Ba, Sr, Zn, Al, and Mn; and colloidal silica in a proportion of 0.5 to 10 mol in terms of $SiO_2$ and at least one member selected from permanganates of Mg, Sr, Zn, Ba, and Ca in a proportion of 0.02 to 2.5 mol in terms of metal elements in the permanganates, relative to $PO_4$:1 mol in the phosphates, and the baking treatment is performed at a temperature of 350° C. or higher and 1100° C. or lower.

Preferably, the treatment solution for insulation coating is chromium-free and, particularly preferably, the treatment solution for insulation coating does not substantially contain Cr. The treatment solution is preferably a water-based solution.

As the rolling, it is preferable to achieve the final sheet thickness by performing cold rolling once, or twice or more including intermediate annealing, after hot rolling or further performing normalizing annealing. Furthermore, it is preferable to apply an annealing separator containing MgO as a primary component after the primary recrystallization annealing, and then perform the secondary recrystallization annealing.

DETAILED DESCRIPTION

Figure 1:
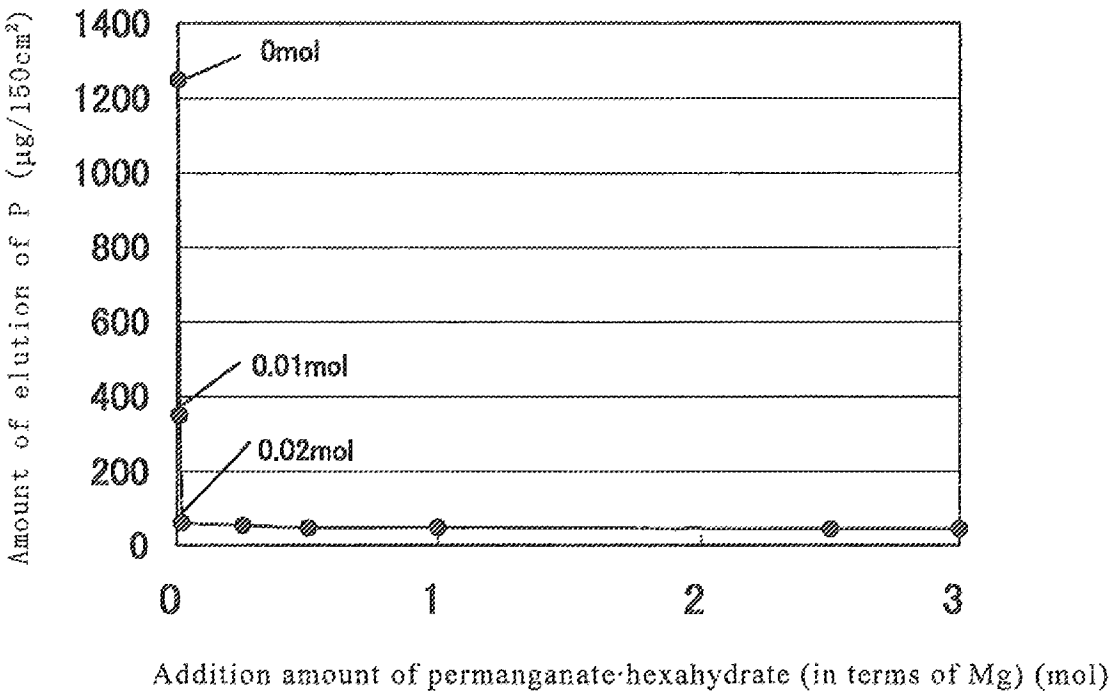
FIG. 1 shows effects of the addition amount of magnesium permanganate-hexahydrate $[Mg(MnO_4)_2.6H_2O]$ (Axis of abscissa: Addition amount in terms of Mg relative to $PO_4$:1 mol, Unit: mol) to a treatment solution for insulation coating on the moisture-absorption resistance of an insulation coating (Axis of ordinates: Amount of elution of P per 150 $cm^2$, Unit: μg).

Hereinafter, experimental results forming the basis of this disclosure will be described.

First, treatment solutions for insulation coating were prepared by mixing the following compounds:

450 ml of a 24 mass % aqueous solution of magnesium phosphate $[Mg(H_2PO_4)_2]$ ($PO_4$:1 mol), 450 ml of colloidal silica (water base) of $SiO_2$:27 mass % ($SiO_2$:2 mol), and magnesium permanganate.hexahydrate $[Mg(MnO_4)_2.6H_2O]$ in a proportion of 0.01 to 3 mol in terms of Mg. For comparison, a treatment solution containing no magnesium permanganate.hexahydrate was also prepared. The magnesium permanganate.hexahydrate was supplied in a solid form, and was dissolved in the treatment solution. The treatment solutions were prepared such that the above mixing ratios were maintained and the amounts of the treatment solutions were sufficient for experiments below.

The treatment solutions for insulation coating were applied to a grain oriented electrical steel sheet (sheet thickness: 0.22 mm) having a forsterite coating after subjected to the secondary recrystallization annealing, and baked at 800° C. for 60 seconds, thereby forming an insulation coating so that the thickness per one side is 2 μm. The grain oriented electrical steel sheet thus obtained was evaluated for the tension induced by a coating, moisture-absorption resistance, rust resistance, and lamination factor by methods described below.

(1) Tension Induced by a Coating

Test pieces having a width of 30 mm and a length of 280 mm were extracted by shearing from the grain oriented electrical steel sheet having an insulation coating such a manner that the lengthwise direction was set to the rolling direction. Subsequently, the insulation coating on one of the both faces is removed. The dimension of the amount of curvature deformation of one end of the test pieces was measured while fixing one end having a length of 30 mm in the lengthwise direction of the steel sheet, and the tension induced by a coating a was calculated from Equation (1). To eliminate the effects of the self weight of the steel sheet, the amount of curvature deformation was measured in such a manner that the lengthwise direction of the steel sheet was set to the horizontal direction and the width direction was set to the vertical direction, respectively.

$$\sigma(\text{MPa})=1.2152\times10^5(\text{MPa})\times\text{Sheet thickness (mm)}\times\text{Deformation (mm)}/250\text{ (mm)}/250\text{ (mm)} \quad \text{Equation (1)}$$

(2) Moisture-absorption Resistance

Three test pieces (50 mm×50 mm) were extracted from the grain oriented electrical steel sheet having an insulation coating, and dipped and boiled for 5 minutes in 100° C. distilled water. Then, the amount of P eluted from the coating surface (amount of elution of P) was quantitatively analyzed, and the average value was determined to be used as the index of the moisture-absorption resistance.

(3) Rust Resistance

The steel sheet having an insulation coating was held in the air having a temperature of 50° C. and a dew point of 50° C. for 50 hours, and then the steel sheet surface was visually observed. Then, the steel sheet free from the formation of rust was defined as (OK) and the steel sheet suffering from the formation of rust was defined as (NG). The area ratio of the rust is approximately lower than 5% when evaluated as (OK) and is approximately 5% or more when evaluated as (NG).

(4) Lamination Factor

The lamination factor was evaluated by a method based on JIS C 2550.

The results are shown in Tables 1 and 2.

Figure 2:
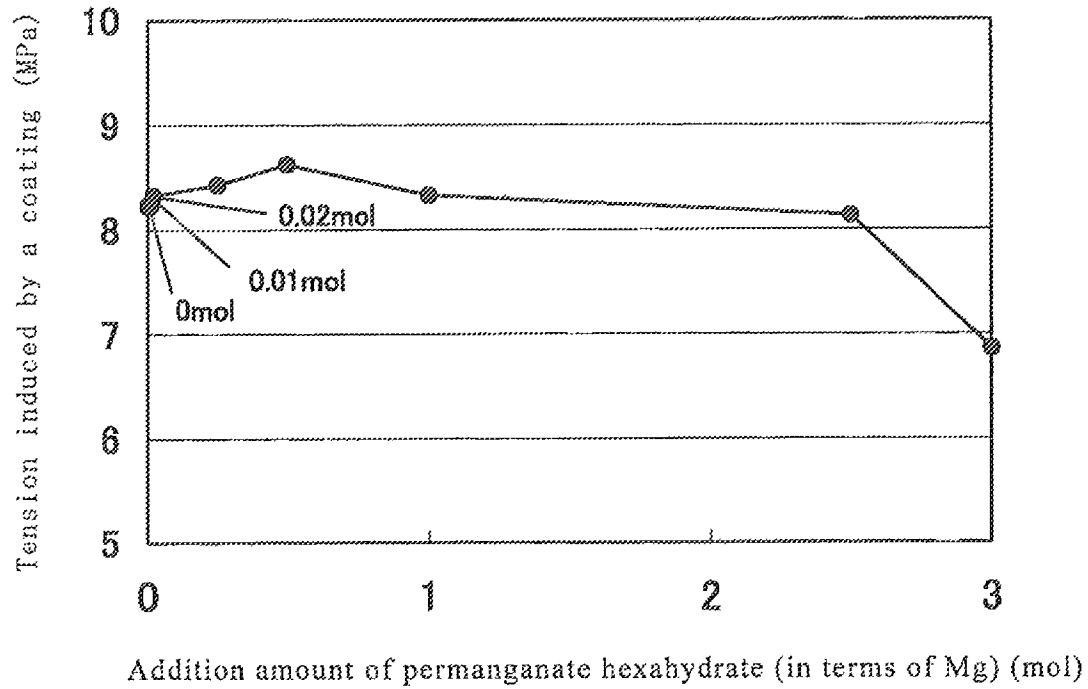
FIG. 2 shows effects of the addition amount of magnesium permanganate.hexahydrate $[Mg(MnO_4)_2.6H_2O]$ (Axis of abscissa: Same as in FIG. 1) to a treatment solution for insulation coating on the tension induced by a coating of an insulation coating (Axis of ordinates, Unit: MPa).

FIG. 1 shows effects of the addition amount of magnesium permanganate.hexahydrate (Axis of abscissa: Addition amount to $PO_4$:1 mol) to a treatment solution for insulation coating on the amount of elution of P, i.e., moisture-absorption resistance, of an insulation coating (Axis of ordinates: per 150 $cm^2$, Unit: μg). FIG. 2 shows effects of the addition amount of magnesium permanganate.hexahydrate (Axis of abscissa) on the tension induced by a coating of an insulation coating (Axis of ordinates, Unit: MPa). The addition amount of the magnesium permanganate.hexahydrate in FIGS. 1 and 2 is the number of moles in terms of Mg.

When the addition amount of the magnesium permanganate.hexahydrate reached 0.02 mol or more relative to $PO_4$:1 mol, the moisture-absorption resistance remarkably improved and the improvement of the tension induced by a coating was also observed. In contrast, when the addition amount exceeded 2.5 mol, the moisture-absorption resistance was satisfactory but the reduction in the tension induced by a coating was observed.

The rust resistance and the lamination factor were excellent when the addition amount of magnesium permanganate-.hexahydrate was in the range of 0.02 to 2.5 mol in terms of Mg.

(Treatment Solution for Insulation Coating)

The treatment solution for insulation coating is preferably a water-based solution. More specifically, the treatment solution for insulation coating contains at least one member selected from phosphates of Mg, Ca, Ba, Sr, Zn, Al, and Mn, colloidal silica, and at least one member selected from permanganates of Mg, Sr, Zn, Ba, and Ca, in which water is preferably used as a solvent.

First, as the phosphates, it is required to select one or two or more members from phosphates of Mg, Ca, Ba, Sr, Zn, Al, and Mn and incorporate the same in the treatment solution for insulation coating. This is because, in the case of phosphates other than the phosphates mentioned above, a coating having favorable moisture-absorption resistance is not obtained when adding no chromium compounds (e.g., chromates). In particular, $Mg(H_2PO_4)_2$, $Ca(H_2PO_4)_2$, $Ba(H_2PO_4)_2$, $Sr(H_2PO_4)_2$, $Zn(H_2PO_4)_2$, $Al(H_2PO_4)_3$, and $Mn(H_2PO_4)_2$, which are primary phosphates of Mg, Ca, Ba, Sr, Zn, Al, and Mn easily dissolve in water, and thus can be preferably used. Moreover, hydrates of the primary phosphates are similarly preferable.

It is required to contain colloidal silica in a proportion of 0.5 to 10 mol in terms of $SiO_2$ relative to $PO_4$:1 mol in the phosphates mentioned above. The colloidal silica forms a low thermal expansion glass with the phosphates mentioned above to produce tension induced by a coating, and thus is an essential component. To demonstrate the effects as mentioned, it is preferable that the proportion be 0.5 mol or more and 10 mol or less in terms of $SiO_2$ relative to $PO_4$:1 mol in the phosphates mentioned above.

The type of colloidal silica is not limited insofar as the stability of the solution or the compatibility with the phosphates mentioned above or the like is obtained. For example, ST-0 (manufactured by Nissan Chemical Industries, LTD., $SiO_2$ content: 20 mass %), which is a commercially available acid-type, is mentioned, and an alkaline-type colloidal silica can also be used.

Since the appearance of the insulation coating is improved, colloidal silica containing a sol containing aluminum (Al) can also be used. In this case, the Al amount is preferably 1.0 or lower relative to $Al_2O_3/SiO_2$ ratio.

To improve the moisture-absorption resistance, it is particularly important for the treatment solution for insulation coating to contain one or two or more members selected from permanganates of Mg, Sr, Zn, Ba, and Ca, which are divalent metals. It is also particularly important to adjust the content of the permanganates of divalent metals mentioned above to be in the range of 0.02 to 2.5 mol in total of Mg, Sr, Zn, Ba, and Ca relative to $PO_4$:1 mol in the phosphates mentioned above.

It is indispensable that the permanganates are contained in such a manner that the total amount of Mg, Sr, Zn, Ba, and Ca is 0.02 mol or more relative to $PO_4$:1 mol in the phosphates to obtain favorable moisture-absorption resistance. In contrast, when the permanganates are contained in such a manner that the total amount of Mg, Sr, Zn, Ba, and Ca exceeds 2.5 mol, the thermal expansion of a coating increases to reduce the tension induced by a coating. As a more preferable addition amount of the permanganates, the total amount of Mg, Sr, Zn, Ba, and Ca is in the range of 0.2 to 1.0 mol.

The permanganates are compounds (metal salts) of $(MnO_4)^-$ and Mg, Sr, Zn, Ba, or Ca and may be hydrates thereof. Among the permanganates, magnesium permanganate and strontium permanganate or hydrates thereof are preferable.

The reason for the increase in the moisture-absorption resistance due to the presence of at least one member selected from the permanganates of Mg, Sr, Zn, Ba, and Ca is considered as follows.

The colloidal silica and the phosphates form glass during baking treatment. $PO_4$ in a free state in the phosphate that was not incorporated into the glass combines with the divalent metals of Mg, Sr, Zn, Ba, and Ca in the permanganates or Mn in the permanganates to form a compound insoluble in water in the insulation coating to thereby increase the moisture-absorption resistance. For example, in the case of permanganate of Mg, $Mg_3(PO_4)_2$ is considered to form in the insulation coating.

As compared with other water-soluble salts, such as sulfate, the permanganates uniformly dissolve in a coating under formation in baking treatment. Therefore, it is considered that $PO_4$ in a free state easily combines with Mg, Sr, Zn, Ba, Ca, or Mn to form a substance insoluble in water. This also contributes to the improvement of moisture-absorption resistance.

In contrast, the use of permanganates of monovalent metals, such as K or Na, causes problems in that the tension induced by a coating deceases and the rust resistance deteriorates. However, these problems are solved by the use of the permanganates of divalent metals. Although we are not quite sure of the mechanism, we believe that when monovalent metals, such as K or Na, are used, these metals cut the bond between the atoms in the glass, resulting in the reduction in the tension induced by a coating or deterioration of the rust resistance.

There is no need to limit the concentration of the primary components mentioned above in the treatment solution for insulation coating. However, when the concentration is low, the insulation coating becomes thin. When the concentration is high, the viscosity of the treatment solution for insulation coating becomes high, resulting in the reduction in workability, such as application. Considering the above facts, it is preferable to adjust the amount of the phosphates mentioned above to be in the range of approximately 0.02 to 20 mol/l in terms of $PO_4$. The concentration of colloidal silica and the permanganates of divalent metals mentioned above are naturally determined when the concentration of the phosphates are determined.

In addition to the above, the following substances may be added to the treatment solution for insulation coating.

First, boric acid may be added to increase the heat resistance of the insulation coating.

To increase the sticking resistance or the slipping properties of a grain oriented electrical steel sheet, one or two or more members selected from $SiO_2$, $Al_2O_3$, and $TiO_2$ having a primary particle diameter of 50 to 2000 nm may be incorporated in the treatment solution for insulation coating. The reason for requiring the sticking resistance is as follows. When a grain oriented electrical steel sheet is used for a wound core type transformer, the steel sheet is rolled to be formed into an iron core, and then subjected to strain relief annealing (e.g., about 800° C.×about 3 hours). In that case, sticking between adjacent coatings sometimes arises. Such sticking reduces the insulation resistance between adjacent sheets of the iron core to thereby deteriorate the magnetic properties. Thus, it is preferable to give sticking resistance to the insulation coating. With respect to the slipping properties, when a grain oriented electrical steel sheet is used for a laminated core type transformer, it is preferable to improve slipping properties between steel sheets so as to smoothly perform stacking of the steel sheets.

In addition to the above substances, various additives that are sometimes used for the treatment solution for insulation coating can be added. It is preferable that the content of the boric acid, $SiO_2$, and the like and other additives be about 30 mass % or lower in total.

It is preferable that the treatment solution for insulation coating be chromium-free and is particularly preferable that the treatment solution for insulation coating does not substantially contain Cr. "Not substantially contain" means that Cr derived from impurities contained in the raw materials is permitted but Cr is not positively added. For example, components, such as the phosphates, colloidal silica, and permanganates mentioned above, are available as commercially available items for industrial use in many cases. An amount of Cr as contained in these commercially available compounds as impurity is acceptable.

(Method for Producing Grain Oriented Electrical Steel Sheet)

Next, a method for producing a grain oriented electrical steel sheet having an insulation coating using the treatment solution for insulation coating will be described.

A steel slab for grain oriented electrical steel sheet having a given component composition is rolled to achieve a final sheet thickness. Thereafter, primary recrystallization annealing and secondary recrystallization annealing are performed, the treatment solution for insulation coating described above is applied to the steel sheet surface and, subsequently, the steel sheet is baked at a temperature of 350 to 1100° C. In general, the slab for grain oriented electrical steel sheet is subjected to hot rolling, then subjected to normalizing annealing as required, and then subjected to cold rolling once, or twice or more including intermediate annealing, to thereby achieve the final sheet thickness.

The component composition of the slab is not limited, and any known component composition is accepted. The production method is also not limited, and any known production method can be used. For information, the primary components of a typical slab for grain oriented electrical steel sheet contain c: 0.10 mass % or lower, Si: 2.0 to 5.0 mass %, and Mn: 0.01 to 1.0 mass %. Si: 2.0 to 4.5 mass % is preferable. In grain oriented electrical steel sheets, various inhibitors are usually used, and elements according to the inhibitors are added in addition to the primary components mentioned above. For example, as the inhibitors, when MnS is used, S: about 200 ppm (i.e., about 100 to 300 ppm: hereinafter ppm means mass ppm) can be added, when AlN is used, sol.Al: about 200 ppm (i.e., about 100 to 300 ppm) can be added, and when MnSe and Sb are used, Mn, Se (about 100 to 300 ppm), and Sb (about 0.01 to 0.2 mass %) can be added.

In the composition, S, Al, N, and Se are generally almost removed from the steel sheet in the secondary recrystallization annealing process to be reduced to the level of impurities.

To the hot rolling of the slab for grain oriented electrical steel sheet, known methods can be applied. The sheet thickness after hot rolling is preferably adjusted to be in the range of 1.5 to 3.0 mm. The hot-rolled sheet after hot rolling may be subjected to normalizing annealing depending on requirement of a further improvement of magnetic properties and the like.

Thereafter, the hot-rolled sheet subjected to hot rolling or further normalizing annealing is subjected to cold rolling to achieve a final sheet thickness. The cold rolling may be once, or the cold rolling may be twice or more including intermediate annealing performed between cold rollings.

The primary recrystallization annealing subsequent to the cold rolling is performed to accelerate the primary recrystallization, but may be performed together with decarburization by controlling the atmosphere or the like. The treatment conditions of the primary recrystallization annealing can be set according to the purpose or the like, and continuous annealing is preferably performed at a temperature of 800 to 950° C. for 10 to 600 seconds. During the primary recrystallization annealing or after the primary recrystallization annealing, nitriding treatment can also be performed using ammonia gas or the like.

A subsequent secondary recrystallization annealing is a process for preferential growth of a so-called "Goss orientation," i.e., the crystal orientation in which the magnetic properties are excellent in the rolling direction, by the secondary recrystallization, out of crystal grains obtained by the primary recrystallization annealing (primary recrystallized grain). The conditions of the secondary recrystallization annealing can be set according to the purpose or the like. The secondary recrystallization annealing is preferably performed at a temperature of 800 to 1250° C. for about 5 to 300 hours.

After the primary recrystallization annealing, an annealing separator containing MgO as a primary component (i.e., sufficiently containing MgO) is generally applied to the steel sheet, and then the secondary recrystallization annealing is performed, thereby producing a forsterite coating on the steel sheet.

In recent years, to further reduce the iron loss of the grain oriented electrical steel sheet, insulation coating treatment has been performed in a state where the forsterite coating is not formed. When the forsterite coating is not formed, an annealing separator is not applied or an annealing separator not containing MgO as a primary component (e.g., alumina base or the like) is applied.

The treatment solution for insulation treatment coating can be applied irrespective of the presence of the forsterite coating.

The treatment solution for insulation coating is applied to the grain oriented electrical steel sheet after the secondary recrystallization manufactured through a series of the processes described above, and then the steel sheet is baked.

The treatment solution for insulation coating may be diluted by adding water or the like to adjust the density for improvement of application properties. Known measures, such as a roll coater, can be used to apply the coating.

The baking temperature is preferably 750° C. or higher. This is because the tension induced by a coating arises by baking at 750° C. or higher. When the grain oriented electrical steel sheet is used for the iron core of a transformer, the baking temperature may be 350° C. or higher. This is because, in the production of the iron core, strain relief annealing is performed at a temperature of about 800° C. for about 3 hours in many cases and, in this case, the tension induced by a coating develops during the strain relief annealing.

In contrast, when the temperature exceeds 1100° C., the tension induced by a coating and the rust resistance deteriorate. Thus, the temperature is adjusted to be 1100° C. or lower. In considering the above facts, the maximum range of the baking temperature is 350° C. or more and 1100° C. or lower.

The thickness of the insulation coating is not limited and the thickness per one side is preferably in the range of 1 to 5 μm. The tension induced by a coating is proportional to the thickness of the coating. Thus, when the thickness thereof is lower than 1 μm, the tension induced by a coating may be insufficient depending on purposes. In contrast, when the thickness thereof exceeds 5 μm, the lamination factor sometimes decreases more than necessary. The thickness of the insulation coating can be adjusted to a target value by the concentration, the application amount, the application conditions (e.g., pressing conditions of a roll coater), etc., of the treatment solution for insulation coating.

EXAMPLES

Example 1

A slab for grain oriented electrical steel sheet containing C, 0.05 mass %, Si: 3 mass %, sol.Al: 0.02 mass %, Mn: 0.04 mass %, S: 0.02 mass %, and a balance of Fe and inevitable impurities was hot-rolled to form a hot-rolled sheet having a sheet thickness of 2.0 mm, and then the hot-rolled sheet was subjected to normalizing annealing at 1000° C. for 60 seconds. Thereafter, the hot-rolled sheet was subjected to a first cold rolling to have an intermediate sheet thickness of 1.5 mm, then subjected to intermediate annealing at 1100° C. for 60 seconds, and then subjected to a second cold rolling to form a cold-rolled sheet having a final sheet thickness of 0.22 mm. Next, the cold-rolled sheet was subjected to primary recrystallization annealing at 820° C. for 150 seconds with decarburization. Thereafter, an MgO slurry was applied thereto as an annealing separator, and then secondary recrystallization annealing was performed at 1200° C. for 15 hours, thereby obtaining grain oriented electrical steel sheets having a forsterite coating.

Next, treatment solutions for insulation coating in which 700 ml (containing 3 mol in terms of $SiO_2$) of colloidal silica (water base) and permanganates indicated in Table 1 in a proportion of 0.01 to 3.0 mol in total in terms of Mg, Sr, Zn, Ba, and Ca was incorporated in 500 ml of aqueous solution containing 1 mol of magnesium phosphate $Mg(H_2PO_4)_2$ in terms of $PO_4$ were prepared. As the amount of the treatment solution, sufficient amount required for the following experiments was prepared while maintaining the mixing ratio mentioned above. The same applies below. The treatment solutions for insulation coating were applied to the surface of the grain oriented electrical steel sheets, and the steel sheets were baked at 830° C. for 1 minute. The thickness of the coating was adjusted so that the thickness per one side was 2 μm.

The following treatment solutions for insulation coating were prepared as Comparative Examples, and grain oriented electrical steel sheets having an insulation coating were produced in the same manner as above.

Treatment solution for insulation coating in which permanganate was not incorporated in the treatment solution for insulation coating, Treatment solution for insulation coating containing 1 mol of magnesium sulfate.heptahydrate in terms of Mg, in place of the permanganate in the treatment solution for insulation coating, Treatment solution for insulation coating in which 700 ml (containing 3 mol in terms of $SiO_2$) of colloidal silica (water base) and 0.5 mol of sodium permanganate in terms of Na were incorporated in 500 ml (containing 1 mol in terms of $PO_4$) of magnesium phosphate $Mg(H_2PO_4$ aqueous solution, Treatment solution for insulation coating in which 700 ml (containing 3 mol in terms of $SiO_2$) of colloidal silica (water base) and 0.5 mol of potassium permanganate in terms of K were incorporated in 500 ml (containing 1 mol in terms of $PO_4$) of magnesium phosphate $Mg(H_2PO_4$ aqueous solution, and Treatment solution for insulation coating in which 700 ml (containing 3 mol in terms of $SiO_2$) of colloidal silica (water base) and chromic anhydride ($CrO_3$) or magnesium dichromate $MgCr_2O_7$ in a proportion of 1 mol, equivalent to Cr, were incorporated in 500 ml (containing 1 mol in terms of $PO_4$) of magnesium phosphate $Mg(H_2PO_4)_2$ aqueous solution.

The grain oriented electrical steel sheets having an insulation coating thus obtained were evaluated for the tension induced by a coating, moisture-absorption resistance, rust resistance, and lamination factor by the following methods.

(1) Tension Induced by a Coating

Test pieces having a width of 30 mm and a length of 280 mm were extracted by shearing from the grain oriented electrical steel sheet having an insulation coating while defining the lengthwise direction as the rolling direction and, subsequently, the insulation coating on one of the both faces was removed. The dimension of the amount of curvature deformation of one end of the test pieces was measured while fixing one end having a length of 30 mm in the lengthwise direction of the steel sheet, and the tension induced by a coating σ was calculated from Equation (1). The amount of curvature deformation was measured in such a manner that the lengthwise direction of the steel sheet was set to the horizontal direction and the width direction was set to the vertical direction, respectively.

$$\sigma(\text{MPa})=1.2152\times10^5(\text{MPa})\times\text{Sheet thickness (mm)}\times\text{Deformation (mm)}/250\text{ (mm)}/250\text{ (mm)} \quad \text{Equation (1)}$$

(2) Moisture-absorption Resistance

Three test pieces (50 mm×50 mm) were extracted from the grain oriented electrical steel sheets having an insulation coating, and dipped and boiled for 5 minutes in 100° C. distilled water. Then, the amount of elution of P of the coating surface was quantitatively analyzed, and the average value was determined to be used as the index of the moisture-absorption resistance.

(3) Rust Resistance

The steel sheets having an insulation coating were held in the air having a temperature of 50° C. and a dew point of 50° C. for 50 hours, and then the steel sheet surface was visually observed, and evaluated based on the area ratio of portions where rust formed.

(4) Lamination Factor

The lamination factor was evaluated by a method based on JIS C 2550.

The measurement results are shown in Table 1.

TABLE 1

| No. | Permanganate Type | Permanganate Chemical formula | Permanganate Addition amount (in terms of mol)*1 | Tension induced by a coating (MPa) | Moisture-absorption resistance*2 (μg/150 cm²) | Rust resistance (%)*3 | Lamination factor (%) | Remarks |
|---|---|---|---|---|---|---|---|---|
| 1 | Strontium permanganate trihydrate | $Sr(MnO_4)_2 \cdot 3H_2O$ | 0.01 | 8.21 | 621 | 30 | 97.7 | Comparative example |
| 2 | Magnesium permanganate hexahydrate | $Mg(MnO_4)_2 \cdot 6H_2O$ | 0.02 | 8.43 | 50 | 0 | 97.8 | Present invention |
| 3 | Strontium permanganate trihydrate | $Sr(MnO_4)_2 \cdot 3H_2O$ | 0.02 | 8.62 | 56 | 0 | 97.8 | Present invention |
| 4 | Calcium permanganate tetrahydrate | $Ca(MnO_4)_2 \cdot 4H_2O$ | 0.02 | 8.62 | 52 | 0 | 97.7 | Present invention |
| 5 | Barium permanganate | $Ba(MnO_4)_2$ | 0.02 | 8.13 | 53 | 0 | 97.6 | Present invention |
| 6 | Magnesium permanganate hexahydrate | $Mg(MnO_4)_2 \cdot 6H_2O$ | 0.5 | 8.33 | 45 | 0 | 97.7 | Present invention |
| 7 | Strontium permanganate trihydrate | $Sr(MnO_4)_2 \cdot 3H_2O$ | 0.5 | 8.23 | 48 | 0 | 97.6 | Present invention |
| 8 | Zinc permanganate hexahydrate | $Zn(MnO_4)_2 \cdot 6H_2O$ | 0.5 | 8.43 | 50 | 0 | 97.7 | Present invention |
| 9 | Strontium permanganate trihydrate | $Sr(MnO_4)_2 \cdot 3H_2O$ | 0.5 | 8.62 | 48 | 0 | 97.8 | Present invention |
| 10 | Magnesium permanganate hexahydrate | $Mg(MnO_4)_2 \cdot 6H_2O$ | 2.5 | 8.23 | 49 | 0 | 97.5 | Present invention |
| 11 | Zinc permanganate hexahydrate | $Zn(MnO_4)_2 \cdot 6H_2O$ | 2.5 | 8.43 | 50 | 0 | 97.8 | Present invention |
| 12 | Strontium permanganate•trihydrate | $Sr(MnO_4)_2 \cdot 3H_2O$ | 2.5 | 8.33 | 50 | 0 | 97.6 | Present invention |
| 13 | Strontium permanganate trihydrate | $Sr(MnO_4)_2 \cdot 3H_2O$ | 3.0 | 6.75 | 50 | 20 | 97.5 | Comparative example |
| 14 | None | — | 0 | 8.13 | 1280 | 70 | 98.0 | Comparative example |
| 15 | Magnesium sulfate heptahydrate*4 | $MgSO_4 \cdot 7H_2O$ | 1.0 | 7.06 | 112 | 0 | 97.4 | Comparative example |
| 16 | Sodium permanganate | $Na(MnO_4)$ | 0.5 | 4.81 | 122 | 20 | 97.5 | Comparative example |
| 17 | Potassium permanganate | $K(MnO_4)$ | 0.5 | 4.32 | 138 | 20 | 97.4 | Comparative example |
| 18*5 | Magnesium permanganate hexahydrate | $Mg(MnO_4)_2 \cdot 6H_2O$ | 0.5 | 8.58 | 35 | 0 | 97.7 | Present invention |
| 19 | Chromic anhydride*4 | $CrO_3$ | 1.0 | 8.19 | 55 | 0 | 97.5 | Comparative example |
| 20 | Magnesium dichromate*4 | $MgCr_2O_7$ | 1.0 | 8.05 | 53 | 0 | 97.6 | Comparative example |

*1 Number of moles in terms of Mg, Sr, Zn, Ba, Ca and Cr relative to $PO_4$: 1 mol
*2 Evaluated based on the amount of elution of P
*3 Evaluated based on the area ratio of a rust development portion
*4 Adding as an alternative of permanganate
*5 Adding 0.1 mol of boric acid and 0.3 mol of $Al_2O_3$ to $PO_4$: 1 mol As shown in Table 1, when the treatment solutions for insulation coating to which permanganates of divalent metals were added in the range of 0.02 to 2.5 mol in terms of metal elements in the salts were used, insulation coatings that are all excellent in the coating properties of the tension induced by a coating, moisture-absorption resistance, rust resistance, and lamination factor were formed. The insulation coating properties of the examples were equal to or more than those of the Comparative Examples to which chromium compounds were added.

Example 2

A slab for grain oriented electrical steel sheet containing C, 0.03 mass %, Si: 3 mass %, sol.A1: lower than 0.01 mass %, Mn: 0.04 mass %, S: lower than 0.01 mass %, Se: 0.02 mass %, Sb: 0.03 mass %, and a balance of Fe and inevitable impurities was hot-rolled to form a hot-rolled sheet having a sheet thickness of 2.5 mm, and then the hot-rolled sheet was subjected to normalizing annealing at 1050° C. for 60 seconds. Then, the hot-rolled sheet was subjected to a first cold rolling to form a cold-rolled sheet having an intermediate sheet thickness of 0.8 mm, and then subjected to intermediate annealing at 1000° C. for 30 seconds. Furthermore, the cold-rolled sheet was subjected to a second cold rolling to achieve a final sheet thickness of 0.30 mm. Next, the cold-rolled sheet having such a final sheet thickness was subjected to primary recrystallization annealing at 850° C. for 60 seconds. Thereafter, an MgO slurry was applied thereto as an annealing separator, and then secondary recrystallization annealing was performed at 880° C. for 50 hours, thereby obtaining grain oriented electrical steel sheets having a forsterite coating.

Next, treatment solutions for insulation coating in which colloidal silica in a proportion of 0.5 to 10 mol (1000 ml of aqueous solution) in terms of $SiO_2$ and permanganates (0.5 mol in total of magnesium permanganate.hexahydrate [$Mg(MnO_4)_2.6H_2O$] in a proportion of 0.2 mol in terms of Mg and zinc permanganate.hexahydrate [$Zn(MnO_4)_2.6H_2O$] in a proportion of 0.3 mol in terms of Zn) were incorporated in 500 ml of aqueous solution of various phosphates indicated in Table 2 (containing 1 mol in terms of $PO_4$) were prepared. Then, the treatment solutions were applied to the surface of the grain oriented electrical steel sheets, and the steel sheets were baked at 800° C. for 60 seconds. The coating thickness after the baking treatment was adjusted so that the thickness per one side was 3 μm.

The grain oriented electrical steel sheets after the baking treatment were evaluated for the tension induced by a coating, moisture-absorption resistance, rust resistance, and lamination factor by the same methods as in Example 1.

The results are shown in Table 2.

TABLE 2

| No. | Phosphate: Type | Phosphate: Chemical formula | Colloidal silica content (mol in terms of $SiO_2$)*1 | Tension induced by a coating (MPa) | Moisture-absorption resistance*2 (μg/150 $cm^2$) | Rust resistance (%)*3 | Lamination factor (%) | Remarks |
|---|---|---|---|---|---|---|---|---|
| 1 | Magnesium primary phosphate•dihydrate | $Mg(H_2PO_4)_2 \cdot 2H_2O$ | 0.5 | 8.53 | 48 | 0 | 97.8 | Present invention |
| 2 | Magnesium primary phosphate | $Mg(H_2PO_4)_2$ | 1.0 | 8.33 | 50 | 0 | 97.7 | Present invention |
| 3 | Magnesium primary phosphate•dihydrate | $Mg(H_2PO_4)_2 \cdot 2H_2O$ | 5.0 | 8.62 | 49 | 0 | 98.1 | Present invention |
| 4 | Magnesium primary phosphate•dihydrate | $Mg(H_2PO_4)_2 \cdot 2H_2O$ | 10.0 | 8.53 | 46 | 0 | 97.9 | Present invention |
| 5 | Calcium primary phosphate | $Ca(H_2PO_4)_2$ | 2.0 | 8.23 | 51 | 0 | 97.7 | Present invention |
| 6 | Barium primary phosphate | $Ba(H_2PO_4)_2$ | 2.0 | 8.33 | 52 | 0 | 97.8 | Present invention |
| 7 | Strontium primary phosphate | $Sr(H_2PO_4)_2$ | 2.0 | 8.33 | 52 | 0 | 97.7 | Present invention |
| 8 | Zinc primary phosphate | $Zn(H_2PO_4)_2$ | 2.0 | 8.43 | 58 | 0 | 97.7 | Present invention |
| 9 | Aluminum primary phosphate | $Al(H_2PO_4)_3$ | 2.0 | 8.53 | 46 | 0 | 97.8 | Present invention |
| 10 | Manganese primary phosphate | $Mn(H_2PO_4)_2$ | 2.0 | 8.33 | 57 | 0 | 97.5 | Present invention |
| 11*4 | Magnesium primary phosphate | $Mg(H_2PO_4)_2$ | 1.0 | 8.33 | 50 | 0 | 97.7 | Comparative example |

*1Number of moles relative to $PO_4$: 1 mol

*2Evaluated based on the amount of elution of P

*3Evaluated based on the area ratio of a rust development portion

*4Adding chromic anhydride (1.0 mol relative to $CrO_3$, per $PO_4$: 1 mol) in place of permanganate As shown in Table 2, when the treatment solutions for insulation coating in which a suitable amount of permanganates of divalent metals was incorporated in substances containing a suitable amount of our phosphates and colloidal silica were used, the insulation coating properties of the tension induced by a coating, moisture-absorption resistance, rust resistance, and lamination factors were all excellent.

Example 3

A slab for grain oriented electrical steel sheet containing C, 0.05 mass %, Si: 3 mass %, sol.Al: lower than 0.02 mass %, Mn: 0.04 mass %, S: 0.02 mass %, and a balance of Fe and inevitable impurities was hot-rolled to form a hot-rolled sheet having a sheet thickness of 2.0 mm, and then the hot-rolled sheet was subjected to normalizing annealing at 1000° C. for 60 seconds. Then, the hot-rolled sheet was subjected to a first cold rolling to form a cold-rolled sheet having an intermediate sheet thickness of 1.5 mm, and then subjected to intermediate annealing at 1100° C. for 60 seconds. Furthermore, the cold-rolled sheet was subjected to a second cold rolling to achieve a final sheet thickness of 0.22 mm. Next, the cold-rolled sheet having such a final sheet thickness was subjected to primary recrystallization annealing at 820° C. for 150 seconds with decarburization. Thereafter, an MgO slurry was applied thereto as an annealing separator, and then secondary recrystallization annealing was performed at 1200° C. for 15 hours, thereby obtaining grain oriented electrical steel sheets having a forsterite coating.

Next, 500 ml of a mixed aqueous solution in which 250 ml (0.5 mol in terms of $PO_4$) of aqueous solution of magnesium phosphate [$Mg(H_2PO_4)_2$] and 250 ml (0.5 mol in terms of $PO_4$) of aqueous solution of aluminum phosphate [$Al(H_2PO_4)_3$] were mixed so that 1 mol in total of $PO_4$ was contained was prepared. Treatment solutions for insulation coating in which 700 ml (3 mol in terms of $SiO_2$) of colloidal silica and 0.5 mol of magnesium permanganate.hexahydrate [$Mg(MnO_4)_2.6H_2O$] in terms of Mg were incorporated in the phosphate aqueous solution were prepared. Subsequently, the treatment solutions were applied to the surface of the grain oriented electrical steel sheets, and the steel sheets were baked for 30 seconds at temperatures (soaking temperature) indicated in Table 3. The coating thickness after the baking treatment was adjusted so that the thickness per one side was 1.5 μm.

The grain oriented electrical steel sheets after the baking treatment were evaluated for the tension induced by a coating, moisture-absorption resistance, rust resistance, and lamination factor by the same methods as in Example 1. To examine the effects of strain relief annealing, the tension induced by a coating was also evaluated after strain relief annealing at 800° C. for 3 hours.

The results are shown in Table 3.

TABLE 3

| No. | Baking temperature (° C.) | Tension induced by a coating before strain relief annealing (MPa) | Tension induced by a coating after strain relief annealing (MPa) | Moisture-absorption resistance*1 (μg/150 $cm^2$) | Rust resistance (%)*2 | Lamination factor (%) | Remarks |
|---|---|---|---|---|---|---|---|
| 1 | 300 | 0.20 | 8.33 | 352 | 40 | 97.9 | Comparative example |
| 2 | 350 | 0.29 | 8.53 | 57 | 0 | 98.0 | Present invention |
| 3 | 500 | 3.14 | 8.43 | 56 | 0 | 98.1 | Present invention |
| 4 | 750 | 7.84 | 8.62 | 52 | 0 | 97.7 | Present invention |
| 5 | 850 | 8.33 | 8.53 | 50 | 0 | 97.7 | Present invention |
| 6 | 900 | 8.72 | 8.72 | 48 | 0 | 98.0 | Present invention |
| 7 | 1000 | 9.31 | 9.31 | 46 | 0 | 97.9 | Present invention |
| 8 | 1100 | 11.76 | 11.76 | 45 | 0 | 97.7 | Present invention |
| 9 | 1150 | 0.20 | 0.20 | 45 | 80 | 97.8 | Comparative example |

*1Evaluated based on the amount of elution of P

*2Evaluated based on the area ratio of a rust development portion

As shown in Table 3, when the temperature of the baking treatment is in the range of 350 to 1100° C., the properties of the tension induced by a coating after strain relief annealing, moisture-absorption resistance, rust resistance, and lamination factor were all excellent.

INDUSTRIAL APPLICABILITY

An insulation coating excellent in the tension induced by a coating, moisture-absorption resistance, rust resistance, and lamination factor can be formed on the surface of a grain oriented electrical steel sheet, and thus the reduction in the magnetostriction of the grain oriented electrical steel sheet and further, the reduction in noise pollution can be achieved.

Moreover, the use of the treatment solution for insulation coating allows production of a grain oriented electrical steel sheet having an insulation coating outstanding coating properties, which are equivalent to those obtained when treatment solutions for insulation coating containing chromium compounds are used, without generating waste liquid containing harmful chromium compounds.

The invention claimed is:

1. A treatment solution for insulation coating for grain oriented electrical steel sheet, comprising:

phosphates of Mg, Ca, Ba, Sr, Zn, Al and Mn, and colloidal silica in a proportion of 0.5 to 10 mol in terms of $SiO_2$ and permanganates of Mg in a proportion of 0.02 to 2.5 mol in terms of metal elements in the permanganates, relative to 1 mol $PO_4$ or equivalent.

2. A treatment solution for an insulation coating for a grain oriented electrical steel sheet, comprising:

at least one member selected from phosphates of Mg, Ca, Ba, Sr, Zn, Al, and Mn;

colloidal silica in a proportion of 0.5 to 10 mol in terms of $SiO_2$, relative to 1 mol $PO_4$ or equivalent; and at least one member selected from permanganates of Mg, Sr, Zn, Ba, and Ca in a proportion of 0.5 to 2.5 mol in terms of metal elements in the permanganates, relative to 1 mol $PO_4$ or equivalent.

3. The treatment solution according to claim 2, which is essentially free of Cr.

4. A treatment solution for an insulation coating for a grain oriented electrical steel sheet, consisting of;

at least one member selected from phosphates of Mg, Ca, Ba, Sr, Zn, Al, and Mn;

colloidal silica in a proportion of 0.5 to 10 mol in terms of $SiO_2$, relative to 1 mol $PO_4$ or equivalent;

at least one member selected from permanganates of Mg, Sr, Zn, Ba, and Ca in a proportion of 0.5 to 2.5 mol in terms of metal elements in the permanganates, relative to 1 mol $PO_4$ or equivalent;

water; and optionally, one or more of boric acid, $SiO_2$, $TiO_2$, and $Al_2O_3$.

* * * * *